US007494571B2

(12) United States Patent
Takamura

(10) Patent No.: US 7,494,571 B2
(45) Date of Patent: Feb. 24, 2009

(54) BELT FOR SHOE PRESS

(75) Inventor: Hiroyuki Takamura, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 243 days.

(21) Appl. No.: 11/435,722

(22) Filed: May 18, 2006

(65) Prior Publication Data

US 2006/0266489 A1 Nov. 30, 2006

(30) Foreign Application Priority Data

May 31, 2005 (JP) ..... 2005-159831

(51) Int. Cl.
*D21F 3/00* (2006.01)

(52) U.S. Cl. ..... 162/358.4; 162/901; 264/284

(58) Field of Classification Search ..... 162/117, 162/306, 348, 358.2, 358.4, 361, 362, 900–904; 264/284, 145, 154–156, 162
See application file for complete search history.

(56) References Cited

U.S. PATENT DOCUMENTS 4,944,820 A * 7/1990 McCarten ..... 156/154
5,152,874 A * 10/1992 Keller ..... 162/358.4
5,965,208 A * 10/1999 Fagerholm et al. ..... 427/428.21
6,425,580 B1 * 7/2002 Yaneda ..... 271/276
6,743,339 B1 * 6/2004 Nilsson et al. ..... 162/358.2
7,128,811 B2 * 10/2006 Watanabe ..... 162/358.4
7,326,321 B2 * 2/2008 Hikida ..... 162/358.4
2002/0060042 A1 * 5/2002 Klerelid et al. ..... 162/358.1
2006/0113052 A1 * 6/2006 Hikida et al. ..... 162/348

* cited by examiner

*Primary Examiner*—Eric Hug
(74) *Attorney, Agent, or Firm*—Wenderoth, Lind & Ponack, L.L.P.

(57) ABSTRACT

A belt for a shoe-press of a paper machine having water drain grooves which are resistant to the occurrence of cracks in side walls of the water drain grooves. The surface condition of the water drain grooves side wall is arranged to be a pear-skin state having minute unevenness. Preferably the surface has an average surface roughness in a range of 10 to 50 micrometers in at least the upper two thirds of the total distance (depth) of the side walls of the water drain grooves between the top of the groove and the bottom thereof. The water drain grooves can be manufactured by rotary cutting blades disposed in a position in contact with a roll around which a belt is wound. The roll and the rotary cutting blades rotate simultaneously and a groove cutting device is shifted in the width direction of the belt so that water drain grooves are formed in the belt. The belt running speed on the roll is set at 2 to 20 m/min, preferably 5 to 15 m/min, and rotation speed of the rotary cutting blades is set at 1,000 to 8,000 rpm.

5 Claims, 3 Drawing Sheets

BELT FOR SHOE PRESS

BACKGROUND OF THE INVENTION

1. Technical Field

The present invention, in a press part of a paper machine, relates to a belt for a shoe-press which goes around while pressurizing a press roll from a press shoe side to remove water from wet paper. Further specifically, the present invention relates to a belt for a shoe-press which is arranged to have a specific surface condition of water drain grooves formed on the surface thereof.

2. Description of the Related Art

In a paper making process in paper manufacturing, water contained in a wet paper is absorbed by transferring water in the wet paper to a felt by pressurizing the felt running between a press roll of a paper machine and a press shoe together with the wet paper placed thereon by a shoe-press mechanism of the paper machine.

A shoe-press mechanism is one widely used in a press device of a paper manufacturing machine, in which when a press belt runs between a press roll of the paper machine and a press shoe, the belt runs accompanying with rotation of the press roll while being pressurized by the press shoe side.

The press belt or the shoe-press belt normally has such a structure that polyurethane resin layers are formed on both sides of a base cloth. The belt is usually provided with water drain grooves on a felt side surface enabling absorption of water squeezed out in a press part. It is important to drain water squeezed out in the press part of a paper machine effectively, and therefore an arrangement to extend many grooves on the felt side surface of the shoe-press belt is considered to be an effective method.

The belt, however, is pressurized intensively in the press part of the paper machine, especially in the shoe-press, which causes wear of the belt surface for the wet paper or deformation of the belt grooves due to the provision of water drain grooves. Particularly, there has arisen a problem of the occurrence of cracks at the groove portions. Therefore, the configuration of the grooves has to be suitable for effective draining of squeezed water as well as being capable of restraining groove deformation and the occurrence of cracks to a minimum.

A number of methods to improve groove configuration have been attempted particularly as a method to restrain deformation of grooves, and to prevent the occurrence of cracks at the root of the grooves. For example, one having rounded roots of grooves with a side wall thereof maintaining a divergence angle of 5 degrees to 15 degrees (Patent document 1), one having groove a configuration that gradually widens towards an upper part thereof (Patent documents 2 and 4), one having a concave curved top surface of a belt with grooves (Patent document 3), one having grooved side walls which are curved towards outside (Patent document 5), one having groove side walls which have inclined surfaces in the opening area, or have spherical portions which extend so as to correspond to the predetermined curve (Patent document 6), and the like can be listed.

[Patent document 1] Publication of Patent Application No. Hei 10-510594

[Patent document 2] Japanese Utility Model Publication No. Hei 1-36960

[Patent document 3] Japanese Patent Application Laid-open No. Sho 64-61591

[Patent document 4] Japanese Utility Model Application Laid-open No. Sho 61-7598

[Patent document 5] Japanese Patent Application Laid-open No. 2001-98484

[Patent document 6] Japanese Patent Application Laid-open No. Hei 11-335992

SUMMARY OF THE INVENTION

Among countermeasures implemented so far to restrain the groove deformation and improve the problem of crack generation, the occurrence of cracks at the roots of grooves has been focused predominantly, and therefore the majority of the countermeasures have been improvement methods of the groove configuration.

It was found, however, that even though cracks at the roots of grooves were eliminated by means of groove configuration improvement, crack problems could not be solved thoroughly. Cracks on the side walls due to the force from the belt surface were also found, and it came out that crack generation on the side walls could not be solved simply by groove configuration improvement alone.

As a result of a study by the inventor of the present invention about the cracks on the side walls of the grooves formed on the belt surface, it was discovered that the occurrence of cracks was influenced significantly by the surface condition of the side wall, and it was ascertained that a certain level of roughness on the surface of the groove side wall presenting just like a pear-skin state with minute unevenness (referred to as pear-skin state, hereinafter) can restrain the generation of cracks, and thereby the present invention was achieved.

That is to say, the present invention is a belt for shoe-press of a paper machine including water drain grooves arranged in the running direction of the belt, a surface of the side wall of the grooves being provided with a pear-skin state having minute unevenness.

The surface of such pear-skin state is to have a suitable roughness and it is preferable that at least the upper two thirds of the total distance (depth) between the top of the groove side wall and the bottom thereof has an average surface roughness in a range of 10 to 50 micrometers.

The water drain grooves with such surface roughness can be manufactured in a following method. A rotary cutting blade is disposed in a position so as to contact a roll around which a belt for a shoe-press is wound, and the roll and the rotary cutting blades rotate simultaneously and the groove cutting device is shifted transversely in the width direction of belt to form the water drain grooves on the belt. In the above method, belt running speed on the roll is set at 2 to 20 m/min, preferably 5 to 15 m/min, rotation speed of rotary cutting blades is set to 1,000 to 8,000 rpm, preferably to 3,000 to 6,000 rpm, and thus grooves can be manufactured.

The surface roughness of water drain grooves arranged as described above can prevent the occurrence of cracks on the groove side walls, and hence a long life of the belt can be achieved.

Also, the water drain grooves having such surface condition of the same as described above can be readily formed by adjusting the rotation speed of the roll and the rotary cutting blades in a process of groove cutting.

DETAILED DESCRIPTION OF THE INVENTION

Figure 1:
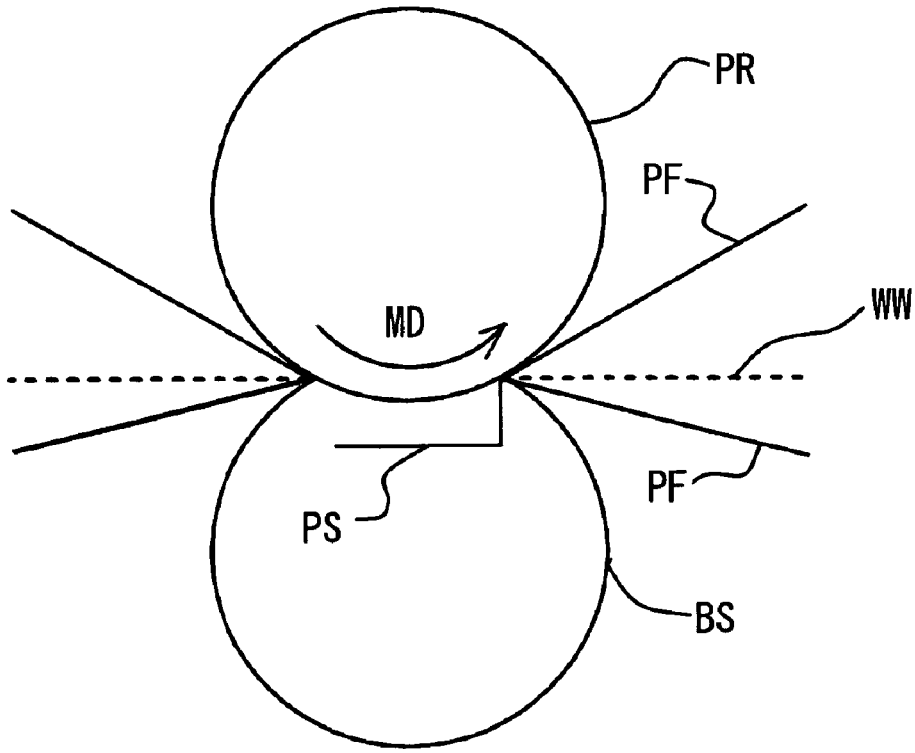
FIG. 1 is a schematic drawing of a press part of a paper machine.

FIG. 1 shows a schematic drawing of the press part in a paper machine.

In FIG. 1, a belt BS runs around between a press roll PR and a press shoe PS. Running felts PF sandwiching wet paper WW therebetween on the belt BS pass through the gap between the press roll PR and the press shoe PS under a pressurized condition, and thereby water contained in the wet paper is squeezed out and absorbed in the felt.

Figure 2:
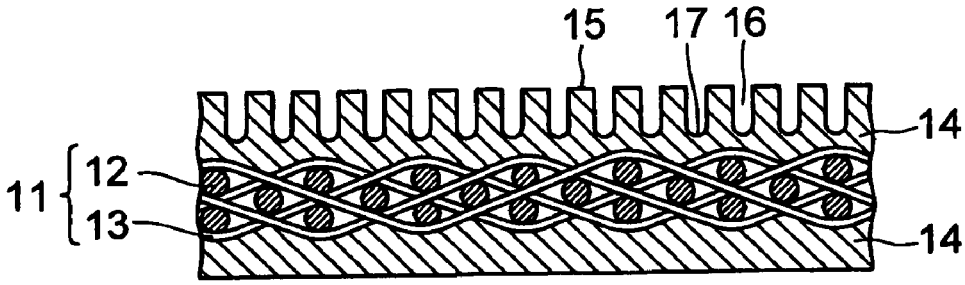
FIG. 2 is a sectional drawing of a belt.

FIG. 2 is a section view of a belt.

The belt is composed of a base cloth 11, on both sides of which polyurethane resin layers 14 are formed. The base cloth 11 includes a belt running direction thread 12 and a belt width direction thread 13.

A number of water drain grooves 16 are provided on the felt side surface 15 of the belt in the belt rotation direction and are useful for draining water squeezed out when the wet paper WW passes through the squeezing gap.

Figure 3:
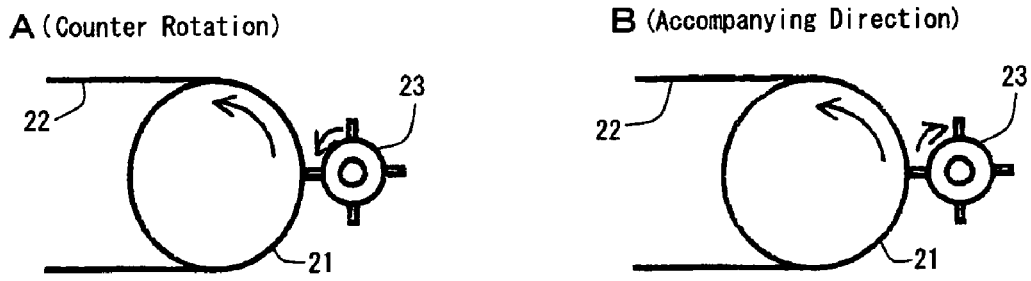
FIG. 3 shows a groove cutting device.

In order to provide the water drain grooves on the surface of the belt, as shown in FIG. 3, the rotary cutting blades 23 are brought into contact with the belt 22 wound around the roll 21, and then the roll and the rotary cutting blades are rotated. The cut off portion by the rotary cutting blades forms the water drain groove. Note that the roll and the groove cutting device with the rotary cutting blades are associated in motion, and the groove cutting device is shifted in the width direction of the belt so that the water drain grooves on the belt are formed.

The side wall surface conditions of the water drain grooves formed by cutting with the rotary cutting blades differ based on the groove cutting conditions. Various outside appearances are presented, such as a very smooth condition (condition of ready to generate cracks due to stress concentration, if a tiny chip like a pin hole should exist), a condition with scratches on the side wall, a condition with regular layer discontinuity, a pear-skin condition, and so on. It was proved that cracks were easily introduced in the portion of pin holes, scratches or layer discontinuity among the conditions above described, but excluding the pear-skin condition, when pressurized intensively in the paper machine press part, especially in the shoe-press.

Figure 5:
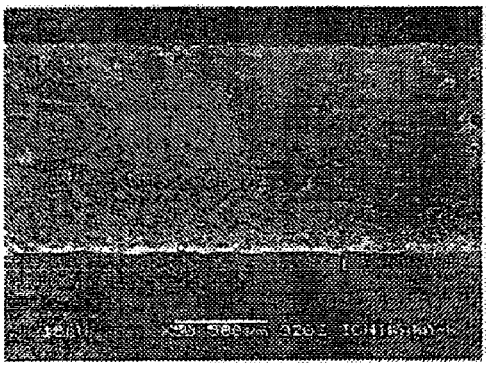
FIG. 5 is a microscopic photograph showing water drain grooves of a belt in an example 1 of the present invention.

According to the present invention, the surface condition of the water drain grooves of the belt are arranged to be a pear-skin condition as shown in a microscopic photograph FIG. 5. Due to this arrangement, it is considered that the stress is dispersed and the occurrence of cracks is prevented. If the surface condition is specifically expressed by a surface roughness value, the belt for a shoe-press is to be provided with an average surface roughness in a range of 10 to 50 micrometers in at least the upper two thirds of the total distance (depth) of the side walls of the water drain grooves between the top (15) of a groove and a bottom (17) thereof.

The surface roughness herein is the one measured by a three-dimensional roughness measuring machine and the measuring method is as follows:

(1) A small piece of a sample is set on a measuring machine.

(2) A roughness measuring sensor is shifted in the direction of the groove cutting direction, and the roughness (Rz) at that time is measured.

(3) Shift distance of the roughness measuring sensor is to be 10 mm and the shifting speed is to be 0.6 mm/sec.

The surface roughness varies depending on the position in the side wall. It is important, however, that the closer position to the wet paper in the side wall surface within the section of belt groove is arranged to be the pear-skin condition, which is tougher against cracks. The present invention adopts the surface roughness of 10 to 50 micrometers at least in the upper two thirds of the total distance (depth) between the top of the groove and the bottom thereof in the side wall of the water drain grooves.

The surface condition described above can be formed through selection and adjustment of the belt groove cutting conditions via rotary cutting blades, for example, rotation direction of the rotary cutting blades, running speed of the belt via rotation of the roller, rotating speed of the rotary cutting blades and the like.

In order to provide the water drain grooves with less occurrence of cracks according to the present invention, it is preferable to perform above operation with the rotary cutting blades rotation speed at 1,000 to 8,000 rpm, more preferably 3,000 to 6,000 rpm, and with the cloth running speed via roller rotation at 2 to 20 m/min, more preferably 5 to 15 m/min.

In a groove cutting operation, both the roller and the rotary cutting blades are rotated. The rotating directions of the roller and the rotary cutting blades can be chosen either of the counter direction, in which the relative moving direction at the contact point between the both is opposite, or the accompanying direction, which is the same direction. For the purpose of forming the water drain grooves with the surface roughness according to the present invention, it is preferable to cut with the same direction of rotation.

On the occasion of forming the water drain grooves on the belt by shifting the groove cutting device in the width direction of the belt, it is more preferable to cool the groove cutting surface of the belt with water spraying, which facilitates formation of the water drain grooves with a pear-skin surface.

As the rotary cutting blades, various types of devices can be used, such as comblike blades (comblike blades having 19 ridges/6.1 cm, 3.18 mm width/ridge, 1.5 mm depth blades are provided with equal pitch, material is SKH-55), chip saw (outside diameter 250 mm, blade thickness 1 mm, number of blades 60, material SKH-51), metal saw (outside diameter 250 mm, blade thickness 1 mm, number of blades 60, material SKH-51), and the like. Specifically, the comb-like blade type is preferable.

The configuration of the grooves is arbitrary, but it is preferable that the groove be formed to have one of the configurations described in Patent documents 1 to 6 in order to prevent the occurrence of crack at the groove root, and thereby cracks at each portion can be prevented as well.

As the material for the belt surface on which grooves are provided, polyurethane elastomer is the most suitable one, the preferable hardness of which is between 90 degrees and 98 degrees in JIS-A scale to obtain the surface roughness according to the present invention on the side wall of the water drain grooves by a groove cutting operation.

EXAMPLES

Example 1

Comparative examples 1 and 2

As rotary cutting blades, comblike blades (comblike blades having 19 ridges/6.1 cm, 3.18 mm width/ridge, 1.5 mm depth blades are provided with equal pitch, material is SKH-55) were used, and a belt for shoe-press of 5 mm thickness was wound around a roll with a diameter of 1 m. The roll and the rotary cutting blades were rotated according to the conditions respectively as shown in Table 1 below to perform the groove cutting operation, and thus water drain grooves having groove width of 1 mm and a groove depth of 1.2 mm were obtained.

Figure 6:
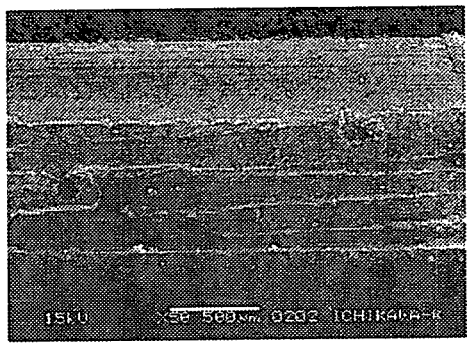
FIG. 6 is a microscopic photograph showing water drain grooves of a belt in a comparative example 1.
Figure 7:
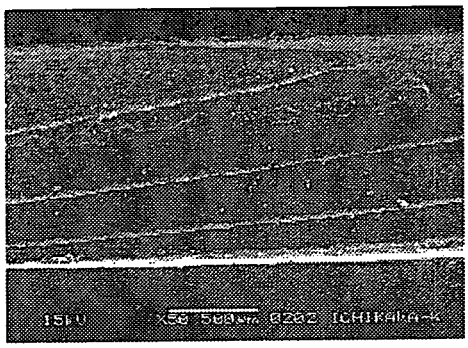
FIG. 7 is a microscopic photograph showing water drain grooves of a belt in a comparative example 2.

Microscopic photographs of groove configurations, surface condition of the groove bottom, and surface condition of the side wall of the grooves formed by the groove cutting operation according to the above described conditions are shown in FIGS. 5, 6 and 7, respectively. Moreover, the average surface roughness of the upper two thirds portion of the total groove side wall was measured by the three-dimensional roughness measuring machine (manufactured by Tokyo Seimitsu Incorporated).

Figure 4:
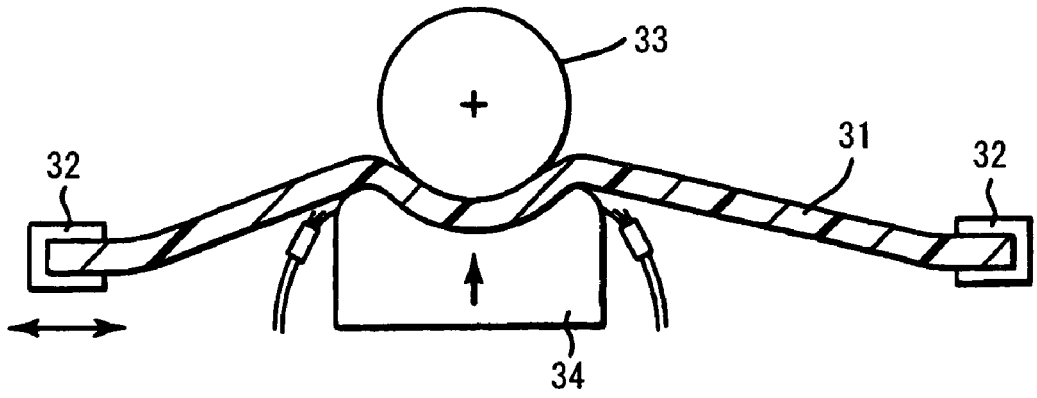
FIG. 4 shows a test device for crack resistance performance.

Further, crack generation tests in the formed water drain grooves were conducted using a device shown in FIG. 4, following the procedure mentioned below.

A test piece 31 is grasped by clamp hands 32, 32, the clamp hands 32, 32 being arranged movably in the right and left direction in a reciprocating manner. The tension force applied on the test piece 31 is 3 kg/cm, and reciprocating speed is 40 cm/sec.

Also, the test piece 31 is sandwiched by a rotary roll 33 and a press shoe 34, and the press shoe is moved toward the rotary roll, and thus the test pieces are pressurized with 36 kg/cm$^2$.

The test piece 31 was repeatedly moved in a reciprocating manner on the same device, and counted the number of reciprocating motions before a crack occurred.

As is obvious from FIGS. 5 to 7, the one in example 1 had a pear-like pattern, meanwhile the ones in the comparative examples 1 and 2 having lower rotation speed and smaller cloth speed had very smooth surfaces but tiny chips and layer discontinuity were observed. The results are shown in Table 1.

TABLE 1

| | Example 1 (FIG. 5) | Comparative example 1 (FIG. 6) | Comparative example 2 (FIG. 9) |
|---|---|---|---|
| Rotation direction of belt and blade | Accompanying direction | Accompanying direction | Accompanying direction |
| Rotation speed of blade | 5,000 rpm | 1,000 rpm | 2,000 rpm |
| Cloth speed | 5 m/min | 3 m/min | 3 m/min |
| Cooling method | Water cooling(12 L/min) | Water cooling(12 L/min) | Water cooling(12 L/min) |
| Surface appearance of groove wall | Pear-skin state | Very smooth surface including tiny chips and pin-holes | Very smooth surface including regular layer discontinuity |
| Surface roughness of groove wall | 30 μm | 5 μm | Smooth surface: 10 μm portion of layer discontinuity: 100 μm |
| Results of crack generation tests on groove wall | No cracks observed on the groove wall even after 200,000 cycles | Crack occurred at a position of chips at the 100,000-th cycle | Crack occurred from a portion of layer discontinuity at the 50,000-th cycle |

Example 2

Comparative example 3

Figure 8:
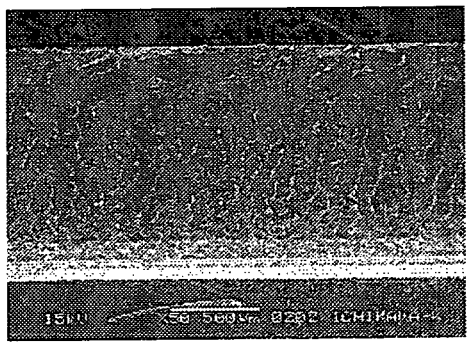
FIG. 8 is a microscopic photograph showing water drain grooves of a belt in an example 2 of the present invention.
Figure 9:
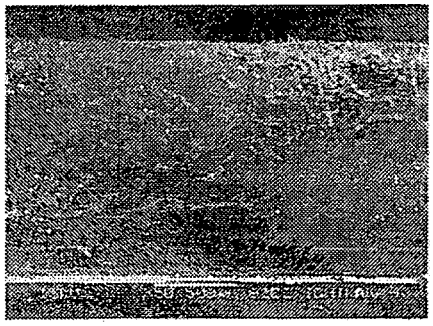
FIG. 9 is a microscopic photograph showing water drain grooves of a belt in a comparative example 3.

As the rotary cutting blades, a chip saw (outside diameter 250 mm, blade thickness 1 mm, number of blades 60, material SKH-51) was used, and the same felt for paper making as in the example 1 was wound around the roll. The roll and the rotary cutting blades were rotated respectively according to the conditions in Table 2 to perform the groove cutting operation and water drain grooves having a groove width of 1 mm and a groove depth of 1.2 mm were obtained. Microscopic photographs of these grooves are shown in FIG. 8 and FIG. 9. The side walls of the water drain grooves present pear-skin patterns. The surface roughness thereof was measured and the results shown in Table 2 were obtained.

TABLE 2

| | Example 2 (FIG. 8) | Comparative example 3 (FIG. 9) |
|---|---|---|
| Rotation direction of belt and blade | Counter rotation | Counter rotation |
| Rotation speed of blade | 3,000 rpm | 3,000 rpm |
| Cloth speed | 15 m/min | 15 m/min |
| Cooling method | Water cooling (12 L/min) | Air cooling |
| Surface appearance of groove wall | Pear-skin state | Irregular coarse Surface |
| Surface roughness of groove wall | 45 μm | 100 μm or more |
| Results of crack generation tests on groove wall | No cracks observed on the groove wall even after 200,000 cycles | Crack occurred on the groove wall at the l00,000-th cycle |

(The Results of Occurrence of Cracks Test)

As is obvious from the results in Tables 1 and 2, groove walls having the pear-skin state according to the present invention did not generate any cracks even in 200,000 times occurrence of crack tests. Meanwhile, in very smooth surfaces having tiny chips and pin holes or in groove side walls including layer discontinuity, cracks occurred easily. Moreover, irregular coarse surfaces (mostly having surface roughness of coarser not less than 100 micrometers), which are not the pear-skin state, generated cracks quickly.

In the present invention, surface roughness having pear-skin state, preferably surface roughness (Rz) in the range of 10 to 50 micrometers in at least the upper two thirds of the distance between the groove top and groove bottom, can prevent the occurrence of cracks in the side walls of the grooves, in addition to the benefit of conventional countermeasures to prevent the occurrence of cracks in the bottom of the grooves, which have been predominantly implemented so far, and hence durability of the belt for paper making is enhanced and the belt life can be prolonged. Due to this, the belt replacement frequency becomes lower, resulting in higher operation rate of the paper machine.

The provision of the water drain grooves having this sort of surface condition can be implemented easily through the rotation speed adjustment of the roller and the rotary cutting blades in the groove cutting operation.

The invention claimed is:

1. A belt for a shoe-press, the belt having water drain grooves arranged in a running direction of the belt, each of the grooves having a depth defined by side walls, wherein an average surface roughness in at least the upper two thirds of the total depth of the side walls of the water drain grooves between a top of the groove and a bottom thereof is in a range of 30 to 50 micrometers.

2. A manufacturing method of a belt for a shoe-press having the water drain grooves according to claim 1, the method comprising:

disposing rotary cutting blades of a groove cutting device at a position contacting a roll around which a belt for the shoe-press is wound;

rotating the roll and the rotary cutting blades simultaneously; and shifting the groove cutting device in a width direction of the belt to form the water drain grooves on the belt, wherein a running speed of the belt on the roll is set at 2 to 20 m/min, and a rotation speed of the rotary cutting blades is set to 1,000 to 8,000 rpm.

3. The manufacturing method according to claim 2, wherein a rotation direction of the roll and a rotation direction of the rotary cutting blades are the same at the point of contact.

4. The manufacturing method according to claim 2, further comprising cooling the surface of the belt in which the grooves were cut by the groove cutting device.

5. The manufacturing method according to claim 4, wherein the grooved surface of the belt is cooled by water spraying.

* * * * *